US007043854B2

(12) United States Patent
Peet et al.

(10) Patent No.: US 7,043,854 B2
(45) Date of Patent: May 16, 2006

(54) PORTABLE SHOE, BOOT AND GARMENT DRYING SYSTEM

(75) Inventors: Blair Peet, St. Maries, ID (US); Gene W. Peet, St. Maries, ID (US)

(73) Assignee: Peet Shoe Dryer, Inc., St. Maries, ID (US)

( * ) Notice: Subject to any disclaimer, the term of this patent is extended or adjusted under 35 U.S.C. 154(b) by 0 days.

(21) Appl. No.: 10/775,755

(22) Filed: Feb. 9, 2004

(65) Prior Publication Data

US 2005/0172509 A1 Aug. 11, 2005

(51) Int. Cl.
*F26B 7/00* (2006.01)

(52) U.S. Cl. ..... 34/381; 34/104

(58) Field of Classification Search ..... 34/90, 34/104, 103, 437, 519, 381, 106
See application file for complete search history.

(56) References Cited

U.S. PATENT DOCUMENTS

| | | | | |
|---|---|---|---|---|
| 2,070,858 | A | 2/1937 | Jardins et al. | |
| 2,098,735 | A * | 11/1937 | Yentis | 219/521 |
| 2,614,337 | A | 10/1952 | Darbo | |
| 2,617,204 | A | 11/1952 | Mann | |
| 3,417,482 | A | 12/1968 | Peet | |
| 4,774,769 | A * | 10/1988 | Dollst | 34/60 |
| 4,787,153 | A * | 11/1988 | Chen | 34/87 |
| 5,289,642 | A * | 3/1994 | Sloan | 34/104 |
| 5,566,838 | A * | 10/1996 | Tseng | 211/37 |
| 5,862,606 | A * | 1/1999 | Jannach | 34/106 |
| D412,381 | S | 7/1999 | Peet | |
| 5,930,913 | A | 8/1999 | Liao et al. | |
| 6,085,436 | A | 7/2000 | Peet | |
| 6,216,359 | B1 | 4/2001 | Peet | |
| 2001/0039991 | A1 * | 11/2001 | Swanson et al. | 156/108 |

FOREIGN PATENT DOCUMENTS

| | | | |
|---|---|---|---|
| EP | 0 291 257 | A | 11/1988 |
| FR | 2 591 882 | A | 6/1987 |
| WO | WO 96/26405 | A | 8/1996 |

OTHER PUBLICATIONS

Website: http://cozywinters.com/bootdryers/.
Website: http://cozywinters.com/shopping/merchant.mv?Screen=PROD&Store_Code=cw&Product_Code=TH-2250-80.
Website: http://www.snowshoecenter.com/shop/product.cfm?p=134.
Website: http://boot-dryer.org/default.htm.
Website: http://www.snowshack.com/snapdry-dryers.html.
Website: http://www.golfskiwarehouse.com/snow_details.aspx?ID=750.

* cited by examiner

*Primary Examiner*—S. Gravini
(74) *Attorney, Agent, or Firm*—Wells St. John P.S.

(57) ABSTRACT

A dryer for insertion into a cavity in a garment, boot or shoe, including a framework with a heated surface on one side of the framework, with the heated surface forming at least one side of an exit airflow passageway to create and induce drying airflow through the cavity of the garment, boot or shoe. The dryer may be configured for an upper cavity and/or lower cavity of the object being dried and may in addition to the airflow, create a temperature differential across the framework to further or create a desired airflow.

27 Claims, 10 Drawing Sheets

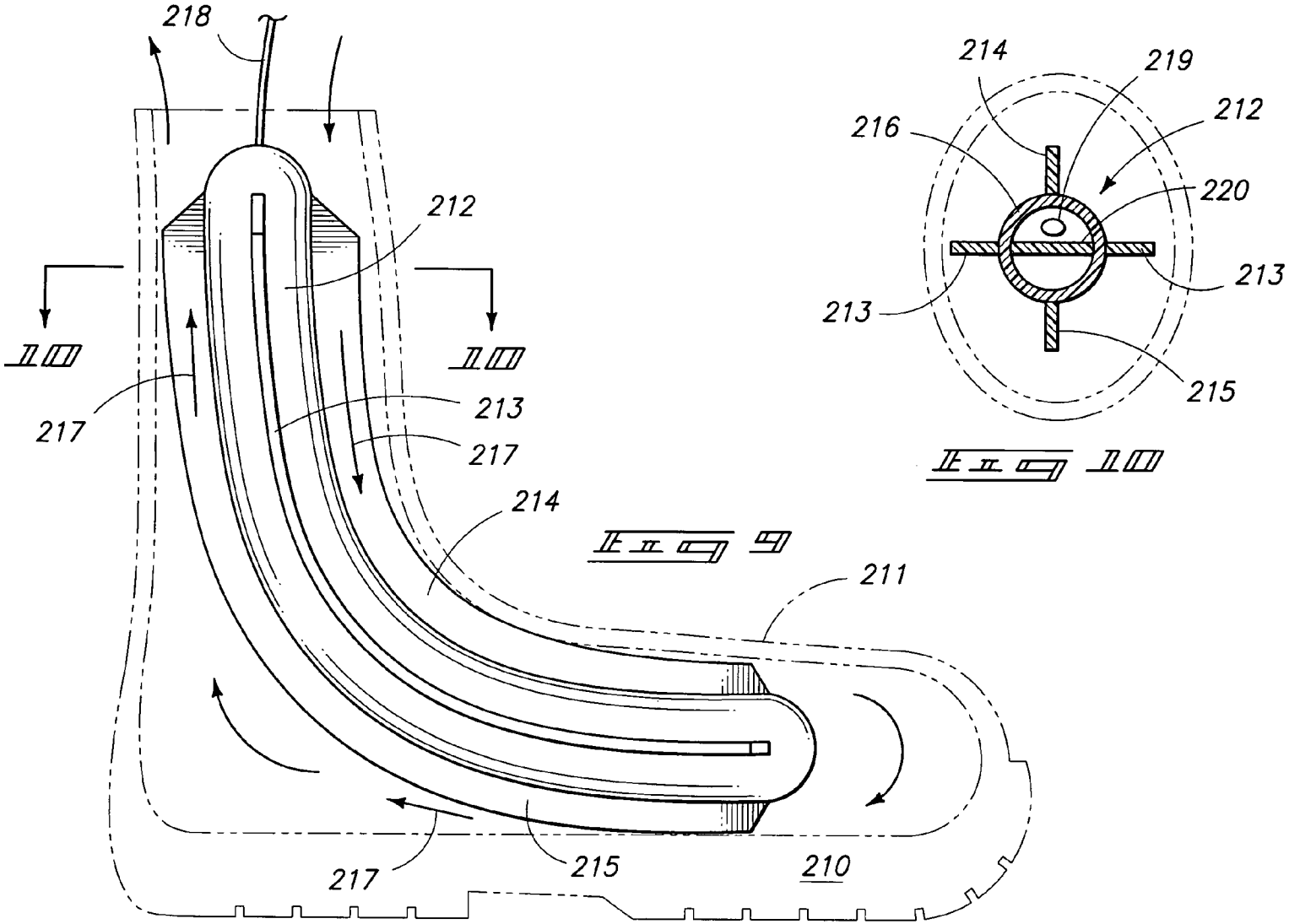
212
220
213
219
215
214
216
213
II
II
II
II
II
211
210
215
214
213
217
212
217
218
217

PORTABLE SHOE, BOOT AND GARMENT DRYING SYSTEM

CROSS REFERENCE TO RELATED APPLICATION

There are no related applications.

TECHNICAL FIELD

This invention generally pertains to a portable shoe, boot and garment drying system for insertion into a shoe or a boot, including an apparatus and a method.

BACKGROUND OF THE INVENTION

There has long been a recognized need to dry garments, shoes and boots, and various devices and methods have been used. For instance dryers such as those disclosed in U.S. Pat. Nos. 3,417,482 and 6,216,359 (which are hereby incorporated herein by this reference), have been employed for drying.

Prior "portable" boot and shoe dryers known to the Applicants have merely provided a cylindrical or other shaped heater for placement in the lower portion of the boot or shoe, typically resting on the inside sole portion of the shoe. It is believed that these prior art heaters do not provide sufficient air flow to remove the desired moisture or vapor from the interior of the shoe or boot.

It is therefore an object of some embodiments or aspects of this invention to provide an improved portable garment, boot or shoe dryer.

It is also an object of this invention to provide a portable boot and shoe dryer which induces sufficient air flow to provide adequate drying characteristics.

BRIEF DESCRIPTION OF THE DRAWINGS

Preferred embodiments of the invention are described below with reference to the following accompanying drawings:

FIG. 4 is a side elevation view of another embodiment of the invention only wherein the lower surface of the lower framework is configured at an angle to further induce airflow of the heated air in the desired direction;

FIG. 5 is a top view of the embodiment of the invention illustrated in FIG. 1;

FIG. 9 is a side elevation view of another embodiment or configuration of this invention positioned within an exemplary boot, and schematically illustrating air flow;

FIG. 10 is section 10—10 from FIG. 9; and

DETAILED DESCRIPTION OF THE PREFERRED EMBODIMENTS

Figure 1:
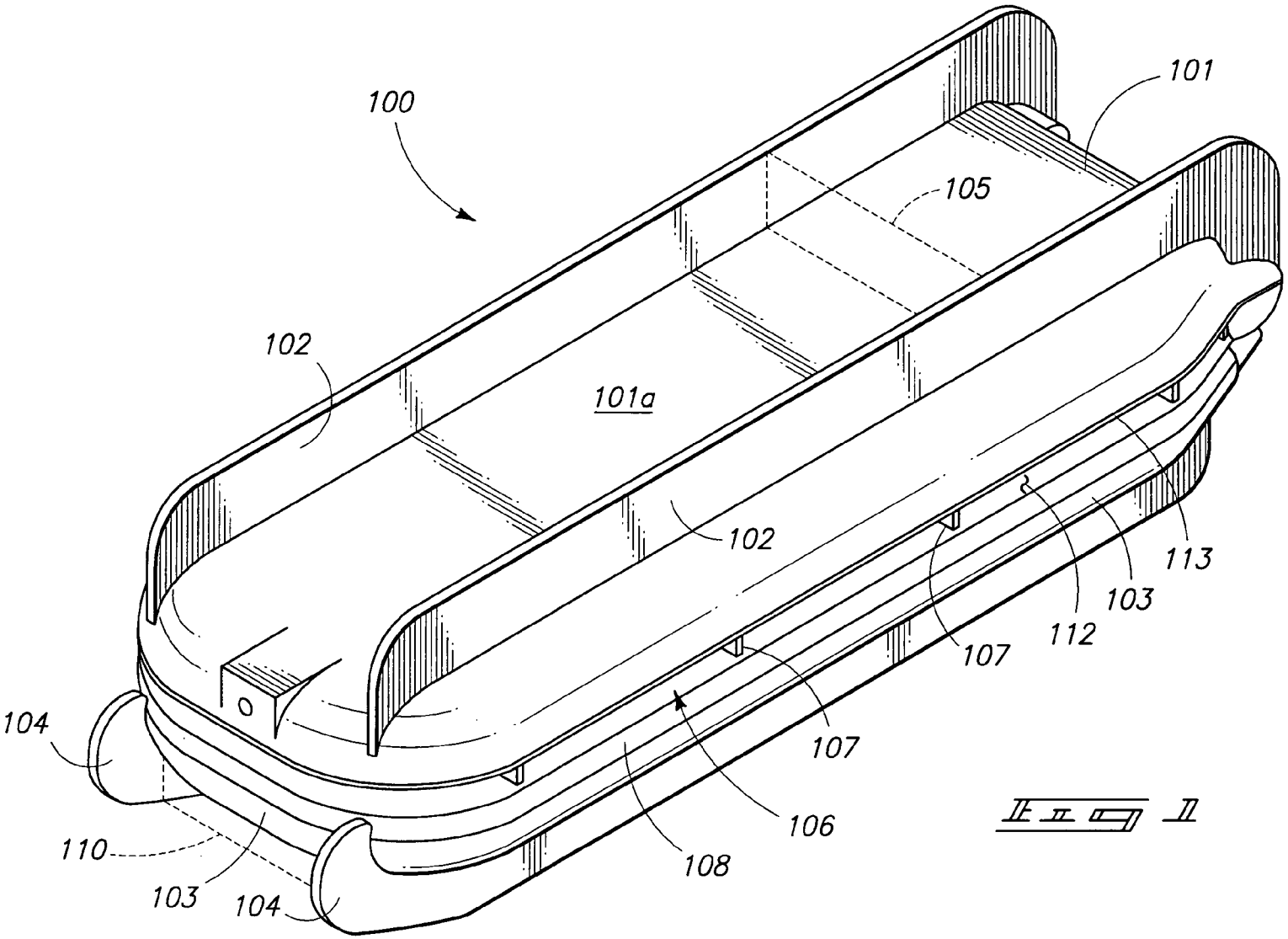
FIG. 1 is a front prospective view of one embodiment of the invention in a folded, compact or traveling configuration.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It will be appreciated by those of ordinary skill in the art that although a more traditionally sized and proportioned boot is shown in the figures, that this invention may be utilized to dry boots with varying heights of the upper portion of the boot, shoes and other garments of different proportions, with no one in particular being required to practice this invention. For instance the upper can be greatly shortened to accommodate the size of the garment, shoe or boot being dried.

For purposes of this invention, a boot or shoe has an internal cavity with a lower portion where the foot is typically positioned during wear, and an upper cavity portion, where an ankle and/or shin may be positioned. The upper cavity portion is typically in an upright configuration or generally vertical, but it need not be.

While the preferred embodiment illustrated in the Figures only shows airflow channels or passageways on one side, a first side, of both the upper cavity framework and the lower framework, the invention contemplates that the invention will be located in the garment, shoe or boot such that an airflow gap is present between the second side of both the upper cavity framework and the lower framework, to allow intake or cooler air to flow thereby. Although it is not necessary in all embodiments of the invention, a spacer may be utilized between either or both of the upper and lower framework and the interior cavity wall of the garment, shoe or boot, to assure a sufficient air gap to allow inflow.

Some embodiments of this invention contemplate a temperature gradient or difference between the first side and the second side of the upper cavity framework and/or the lower framework, and there may be numerous ways to accomplish or achieve the temperature gradient. A few examples are: heat shields such as reflectors; insulation between the heater and the second or cooler side, which may include an air gap or some form of insulation material; a greater spacing or distance from the heater to the second side versus the first side; or others, with no one in particular being required to practice the invention.

Those of ordinary skill in the art will also appreciate that any one of a number of different heaters or heating elements, and configurations thereof, may be used in different aspects or embodiments of this invention, with no one in particular being required to practice the invention. For instance, a resistance coil wire such as Nichrom (which is approximately sixty percent nickel), drawing approximately one-half of an amp, may be utilized.

It will also be appreciated by those of ordinary skill in the art that any one of a number of power sources may be utilized, such as an AC adapter transformer, batteries, or other source of heat such as the sun, to provide the source of additional heat to the exit airflow surface. Heat sinks, solar receivers, black surfaces for placement in the sun, and others are also contemplated.

FIG. 1 is a front perspective view of one embodiment of the invention illustrating a dryer 100 with first side 101 with heated surface 101*a* and spacers or exit airflow passageway walls 102, which may provide two sides to an exit airflow passageway 105 for this upper cavity framework. Alternatively, the exit airflow passageway walls 102 may merely provide the spacing to assure there is sufficient distance between the inside surface of the boot or shoe and the heated surface (or in the case of the second side 108 which is not heated, the second surface). FIG. 1 also illustrates lower framework 103 with spacers or exit airflow passageway walls 104, which provide for an air channel or air passageway 110 beneath the lower framework 103 and between the lower framework 103 and the inside bottom of the shoe or boot. The lower framework would be positioned in the lower cavity portion of a shoe or boot and the upper cavity framework would be positioned in the upper or more upright cavity of a shoe or boot, as shown in later figures, and is intended as an exit passageway.

FIG. 1 further illustrates second side 108 to the upper cavity framework and air gap 106 between one portion of the upper cavity framework and a second portion, the air gap 106 providing some insulation. Surface 112 may (but need not) include a heat shield or reflective surface to resist heat to the second side of the upper cavity framework to provide a better temperature differential between the first side 101 of the upper cavity framework and the second side 108 of the upper cavity framework, as described more fully below. While a temperature differential in some embodiments of this invention is approximately ten degrees, there is no particular differential required to practice this invention.

A heat shield 113 may additionally be inserted between a heating element (shown in a later Figure) positioned within the upper cavity framework and the second side 108 of the upper cavity framework to provide additional insulation and heat shielding functionality to further a temperature differential between a first side 101 and a second side 108 of the upper cavity framework in this embodiment of the invention. While the same may be utilized in the lower framework as shown for the upper cavity framework, it is not believed to be as effective due to the generally horizontal orientation of the lower framework and the tendency of heat to rise.

In some embodiments of the invention, an approximate eight degree Fahrenheit to twelve degree Fahrenheit temperature differential between the heated surface 101*a* on the first side 101 of the upper cavity framework and the cooler surface on the second side 108 of the upper cavity framework may be utilized. It will be appreciated by those of ordinary skill in the art that there are numerous ways to achieve such a temperature differential between the two sides of the upper cavity framework and these components, individually or in combination, and others, may be used in order to achieve this temperature differential with no one in particular being required to practice all embodiments of this invention.

Embodiments of this invention further provide exit airflow passageway walls on either or both of an upper framework and/or a lower framework. The exit airflow passageway walls may be formed by the heated surface and one or more walls, and preferably utilizing the interior wall of the boot or object being dried as one or more of the exit airflow passageway walls, all within the contemplation of this invention. It will also be appreciated that a spacer (as shown in FIGS. 9 & 10) may be utilized as an exit airflow passageway wall, which may partially or wholly partition the exit airflow passageway into two or more sections or passageways, within the contemplation of this invention.

It will also be appreciated and understood by those of ordinary skill in the art that the term "airflow passageway" refers to a predetermined, designated or planned area through which air can flow. The air flow channel does not need to be surrounded on all sides and there may even be gaps between the sides of the upper cavity framework and the sides of the boots where air may escape. However, for purposes of this invention, the area where the exit flow (for example) may occur is still an air channel for purposes of this invention.

Those of ordinary skill in the art will also appreciate that the term heated surface is a surface to which heat is provided directly or indirectly by any known means, so long as an approximate desired temperature is reached, whether by conduction, convection, electrical resistance, a combination of types, or any other means.

Figure 2:
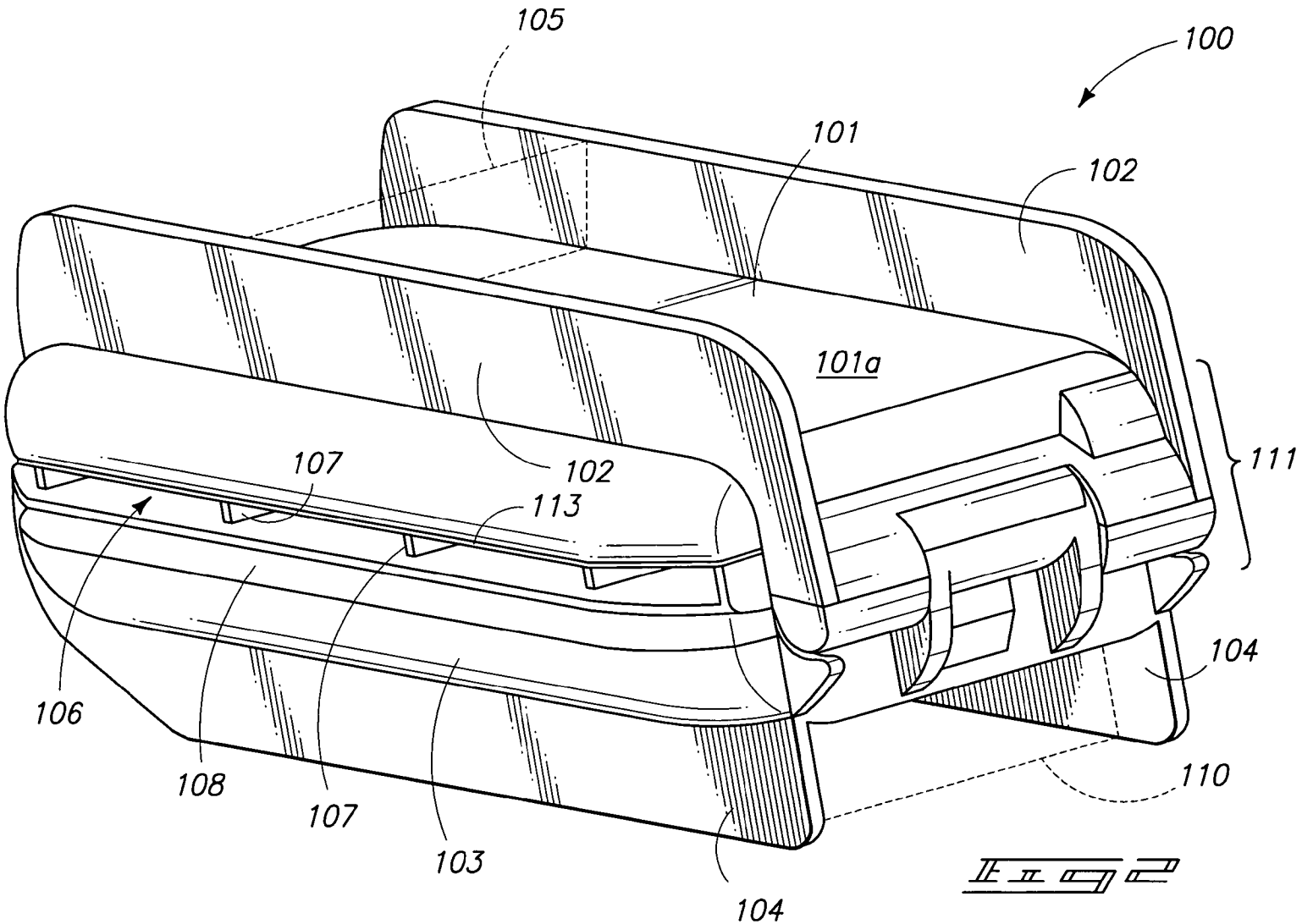
FIG. 2 is a rear prospective view of one embodiment of the invention in a folded, compact or traveling configuration.

FIG. 2 is a rear prospective view of the embodiment of the invention illustrated in FIG. 1, showing first side 101 of the upper cavity framework, with heated surface 101*a* and spacers or exit airflow passageway walls 102 providing an exit airflow passageway 105 in the upper cavity framework for the flow of heated air upward and out of the shoe or boot being dried. The hinge 111 provides a mechanism by which the upper cavity framework may be rotated or pivoted relative to the lower framework, with the position shown in FIG. 2 being the travel or contracted position (which may be preferred in some of the embodiments of this invention for compactness and ease of transporting the invention).

FIG. 2 also illustrates a first side 103 of the lower framework, exit airflow passageway walls 104 which combined with the lower framework 103 provide sides to the lower framework air passageway 110.

FIG. 2 further illustrates spacers 107 creating an air gap 106 between heat shield 113 and the second side 108 of the upper cavity framework. As further discussed elsewhere herein, it is desired to obtain a higher temperature on the heated surface than on the opposed second side of the framework, and there are multiple ways to accomplish this, such as by providing heat insulation between the heater and the second side, or at least more materials and objects that insulate (or shield) than between the heater and the heated surface. It will also be appreciated that the heater and the heated surface may be integral or one in the same. A temperature differential will assist in creating desired air flow through the garment, shoe or boot to be dried.

Figure 3:
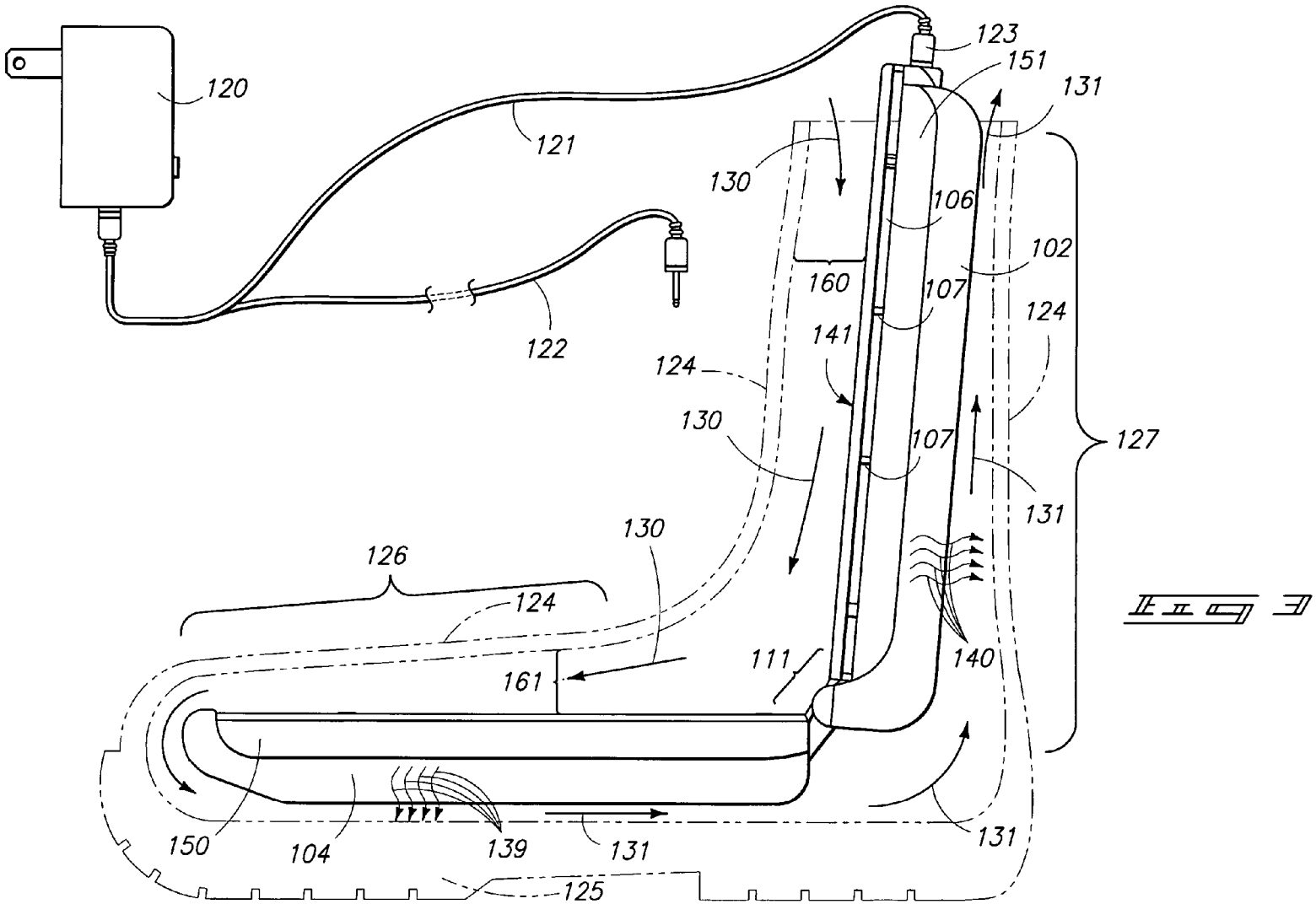
FIG. 3 is a side elevation view of one embodiment of this invention positioned within an exemplary boot, and schematically illustrating air flow.

FIG. 3 is a side view of one embodiment of this invention placed within an exemplary boot. FIG. 3 shows a boot with a lower boot portion 126, an upper boot portion 127, a boot sole 125 and a boot wall 124.

Electrical transformer 120 may be utilized to facilitate providing the electrical current to the invention, preferably transforming the AC power received into a twelve volt source of electricity or power for use by the one or more electrical resistance heaters that may be utilized by this invention. Although electrical resistance is the source of heat and a transformer 120 is configured for insertion into a typical electrical outlet, any one of a number of sources of energy and/or heat may be utilized within the contemplation of this invention, with no one in particular being required to practice it. Electrical power transformer 120 has electrical conductors 121 and 122 operatively attached thereto to provide the necessary current for operation of the boot dryer shown in FIG. 3, with adapter or coupler 123 being insertable into a receiver or electrical coupler to operatively attach the conductor 121 to the upper cavity framework 151. Such electrical connections and the like are well known.

FIG. 3 illustrates upper cavity framework 151 generally upright in the upper portion 127 of the boot, and lower framework 150 generally horizontally oriented in the lower portion 126 of the boot. It will be noted that the lower framework exit airflow passageway walls 104 may be configured such that they orient the lower surface of the lower framework at an angle as shown more fully in FIG. 4, to better facilitate or promote the upward flow of heated air as shown by arrows 131.

FIG. 3 illustrates an airflow pattern showing inlet airflow 130 and exit airflow 131. Upper inlet air passageway 160 and lower inlet air passageway 161 are shown and provide a passageway through which the inlet air is intended to flow and induced to flow. After passing through the toe portion of the boot the air flows toward its intended exit, the exit airflow 131 is shown in the airflow channels and passageways beneath the lower framework 150 and behind the upper cavity framework 151.

By creating a heat differential between a first surface (not shown in FIG. 3) of the upper cavity framework 151, and a second surface 141: of the upper cavity framework 151, it is intended that the higher temperature surface on the first side of upper cavity framework 151 impart heat 140 into the airflow 131 and thereby causing or further promoting or causing the warmer or heated air to rise. Heat 139 is also imparted into the exit airflow 131 in the lower framework 150 and provides air with a higher buoyancy which will be provided an airflow channel or passageway and further facilitate the rising of the air. As the heated or warmer exit airflow 131 exits the boot, that is intended to and believed to induce inlet airflow 130 of cooler air. It is believed that if a mere heater is inserted in the upper and/or lower portion of the boot and an air passageway is not provided and/or a temperature differential is not provided, sufficient airflow will not be achieved to result in the level of drying desired.

It will be appreciated by those of ordinary skill in the art that within the scope and operation of this invention, there may be additional or other airflows, eddies, variant airflow, or air currents which may not all be consistent with the airflow shown in FIG. 3.

FIG. 3 further illustrates components labeled in prior figures and they will not therefore be identified and discussed in detail here.

FIG. 4 is a side elevation view of another embodiment of the invention, similar to the embodiment illustrated in FIG. 1, only wherein the bottom surface of lower framework 103 is oriented or sloped at angle 97, to facilitate exit airflow from that area upward as shown in FIG. 3. Distance 98 is less than distance 99 on the exit airflow passageway walls 104, thereby creating angle 97. Although not required to practice this invention, the configuration of the lower surface of lower cavity framework 150 may be utilized in embodiments of the invention.

FIG. 4 further shows upper cavity framework 151, lower cavity framework 150, air gap 106 in upper cavity framework with spacers 107 in air gap 106. Exit airflow passageway walls 102 and heat shield 113 are also shown, with air gap surface 112 and second side 108 of upper cavity framework 151. The lower framework illustrated includes lower framework exit airflow passageway walls 104 and first side 103. Heat shield 113 may be any one of a number of different types, such as a metallic shield, a reflective or other, all of which are well known.

FIG. 5 is a top view of the embodiment of the invention illustrated in FIG. 1, showing heated surface 101*a* on first side 101, exit airflow passageway 105, lower framework air passageway 110 bordered by lower framework exit airflow passageway walls 104. The exit airflow passageway 105 is bordered by exit airflow passageway walls 102.

Figure 6:
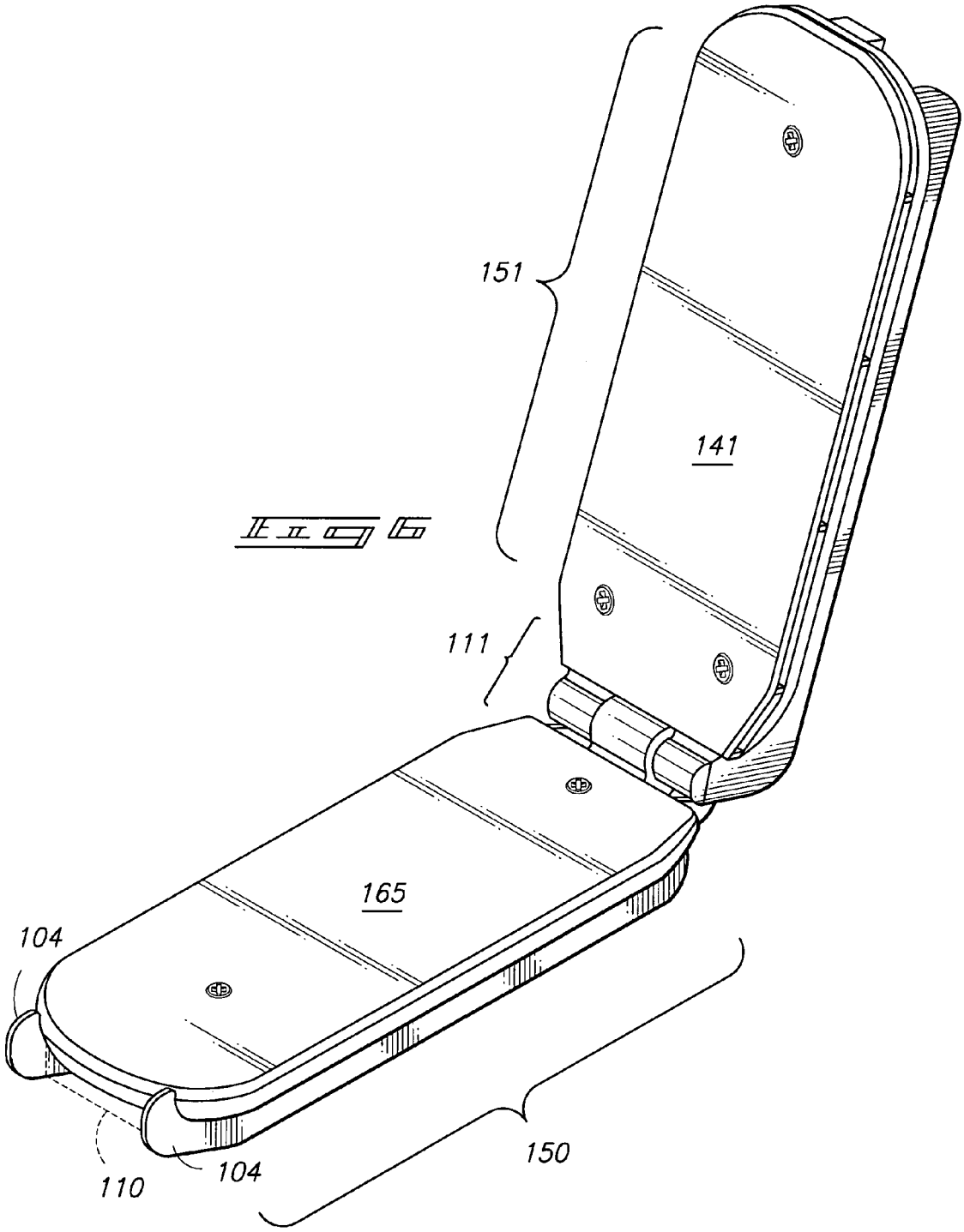
FIG. 6 is a front perspective view of the embodiment of the invention illustrated in FIG. 1, in an opened position.

FIG. 6 is a front prospective view of the embodiment of the invention illustrated in FIG. 1 in a typical open position as it would be unfolded or expanded, for instance in a boot application. FIG. 6 shows upper cavity framework 151, pivotally attached to lower framework 150 by hinge 111. FIG. 6 further illustrates lower framework exit airflow passageway walls 104 forming a portion of the air passageway 110. FIG. 6 also shows second side surface 141 of upper cavity framework 151, which would be the cooler side of the temperature differential. For purposes of this invention, although the term upper cavity framework is utilized, the same framework may be utilized as a lower cavity framework, alone or in combination with the same or a differently configured upper cavity framework.

In an embodiment of the invention, the temperature of second side surface 141 may preferably be in the eighty to eighty-five degrees Fahrenheit temperature range, while the temperature on the heated surface 101*a* (shown in prior figures) of upper cavity framework 151 may approximately be in the ninety-five to ninety-eight degrees Fahrenheit temperature range. The temperature range may also vary based on numerous conditions, such as boot cavity configuration, size, ambient temperature, and others, creating variations in the application and operating characteristics of this invention. In one embodiment of the invention, the resistant heater provided with an upper cavity framework 151 would be an approximate four watt heater and the heater in the lower framework 150 would be an approximate six watt heater. The approximate temperature reached as a result of the heater in the lower framework 150 is approximately ninety-five degrees Fahrenheit. It is preferable that the lower side and lower side surface of the lower framework operate at a higher temperature (although not necessary), but it is believed to be more important that there be a temperature differential between the upper cavity framework surfaces.

Figure 7:
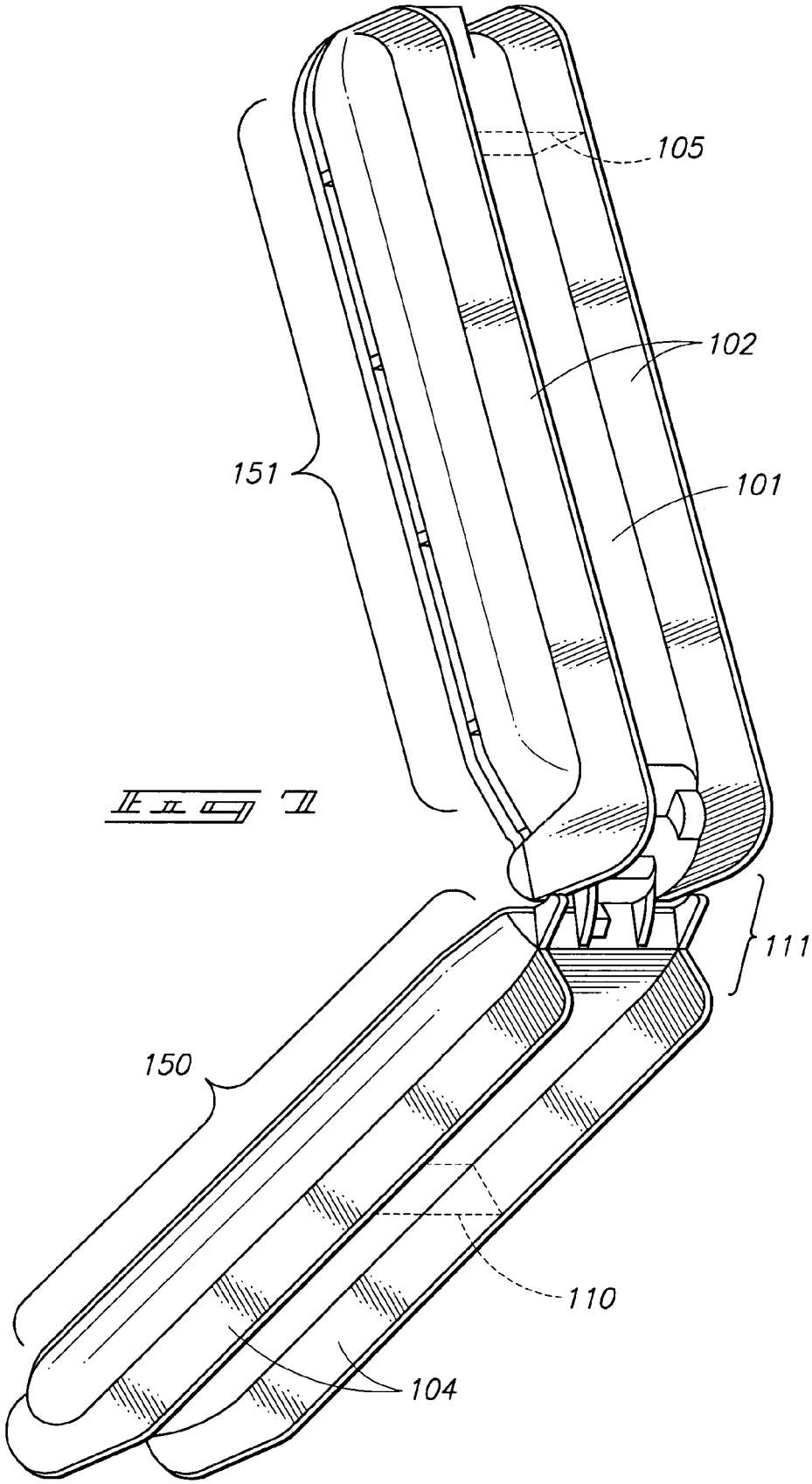
FIG. 7 is a rear perspective view of the embodiment of the invention illustrated in FIG. 6.

FIG. 7 is a rear perspective view of the embodiment of the invention illustrated in FIG. 6, illustrating upper cavity framework 151, pivotally attached to lower framework 150 by hinge 111. FIG. 7 further illustrates lower framework exit airflow passageway walls 104 forming a portion of the air passageway 110. FIG. 7 shows exit airflow passageway 105 bordered by exit airflow passageway walls 102 at a first side of upper cavity framework 151.

Figure 8:
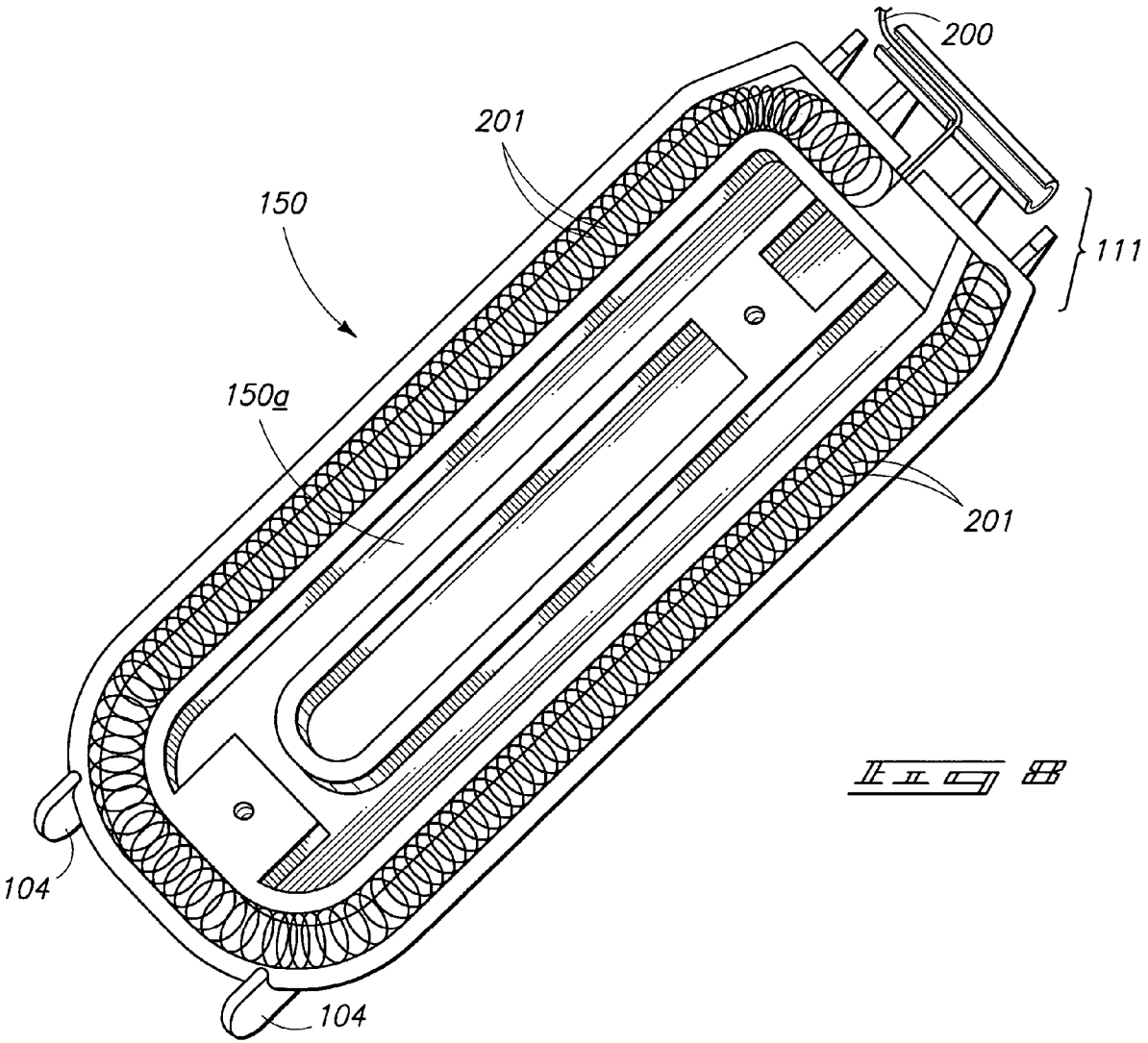
FIG. 8 is a top view of the interior of the upper or lower framework of an embodiment of the invention.
Figure 11:
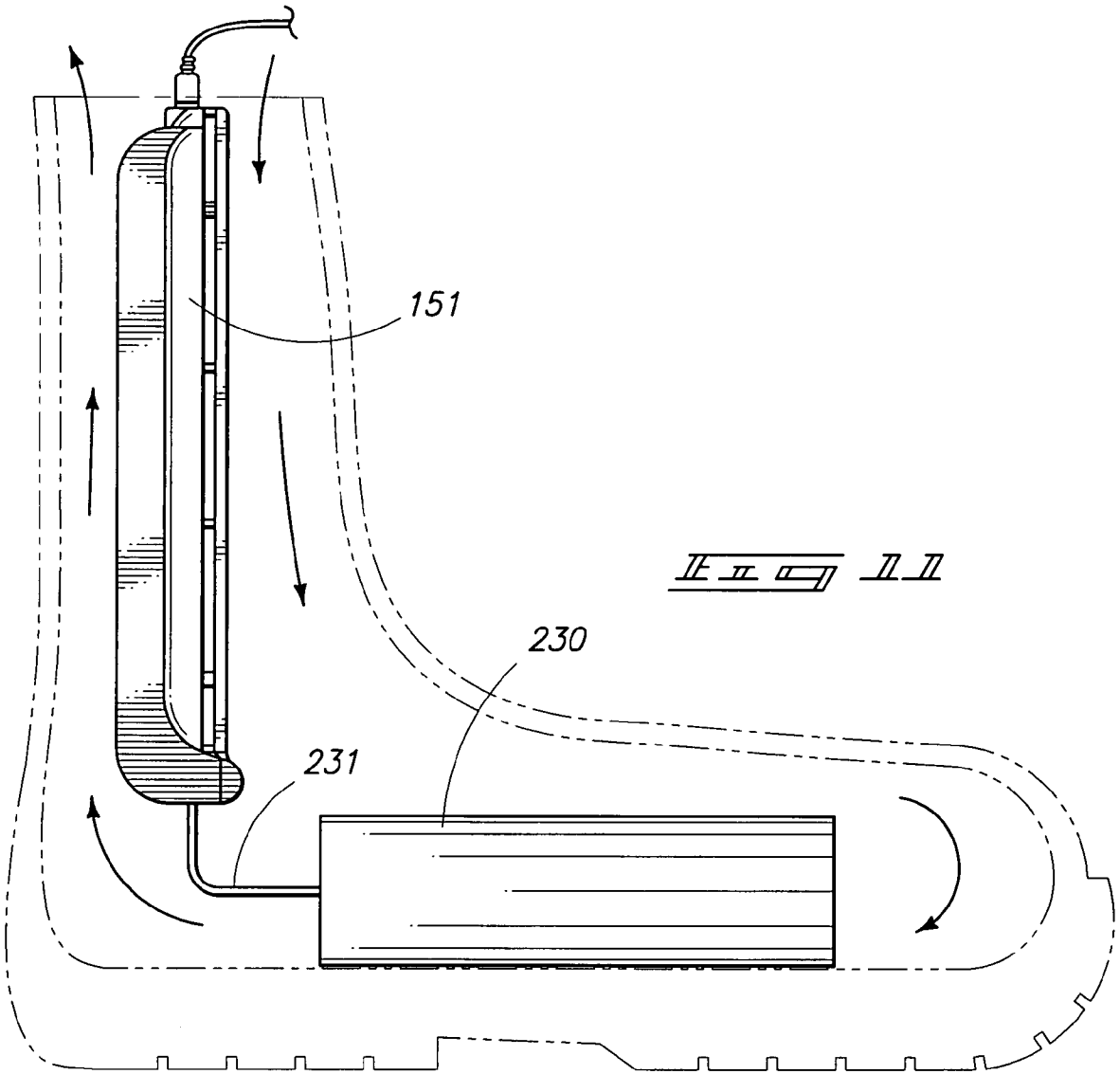

FIG. 8 is a top view of the interior of the upper or lower framework of an embodiment of the invention, labeled as the lower cavity framework for purposes of labeling component, keeping in mind it could be either. FIG. 8 illustrates lower cavity framework 150, lower cavity interior 150*a*, exit airflow passageway walls 104, hinge 111, and conductor 200 which provides the electricity for resistance heater 201.

FIG. 9 is a side elevation view of another embodiment or configuration of this invention positioned within an exemplary boot (boot sole 210 and boot body 211), and schematically illustrating airflow in the boot. FIG. 9 illustrates electrical conductor 218, unitary framework 212, which may be provided for the lower cavity of an object to be dried, for an upper cavity, and/or both cavities. Unitary framework 212 includes upper spacer 214, lower spacer 215 assuring a sufficient air passageway for the drying airflow 217 through the boot. Framework 212 includes fins 213 which divide or substantially divide the exit airflow passageway from the inlet airflow passageway. The unitary framework 212 may be rigid and shaped to sufficiently fit into the desired boot configuration (as one example), or it may be flexible or semi-flexible to adjust and conform to the cavity in which it is being utilized, all within the contemplation of this invention.

FIG. 10 is section 10—10 from FIG. 9, illustrating unitary framework 212, fins 213, spacers 214 and 215 and body 216. The interior of the body would include heater 219 configured, located and/or insulated to provide more heat to the exit airflow side of the boot cavity, for the reasons set forth elsewhere herein. An insulator 220 may be provided to assist in creating a temperature differential between surfaces if desired for a particular embodiment of the invention.

Figure 11:
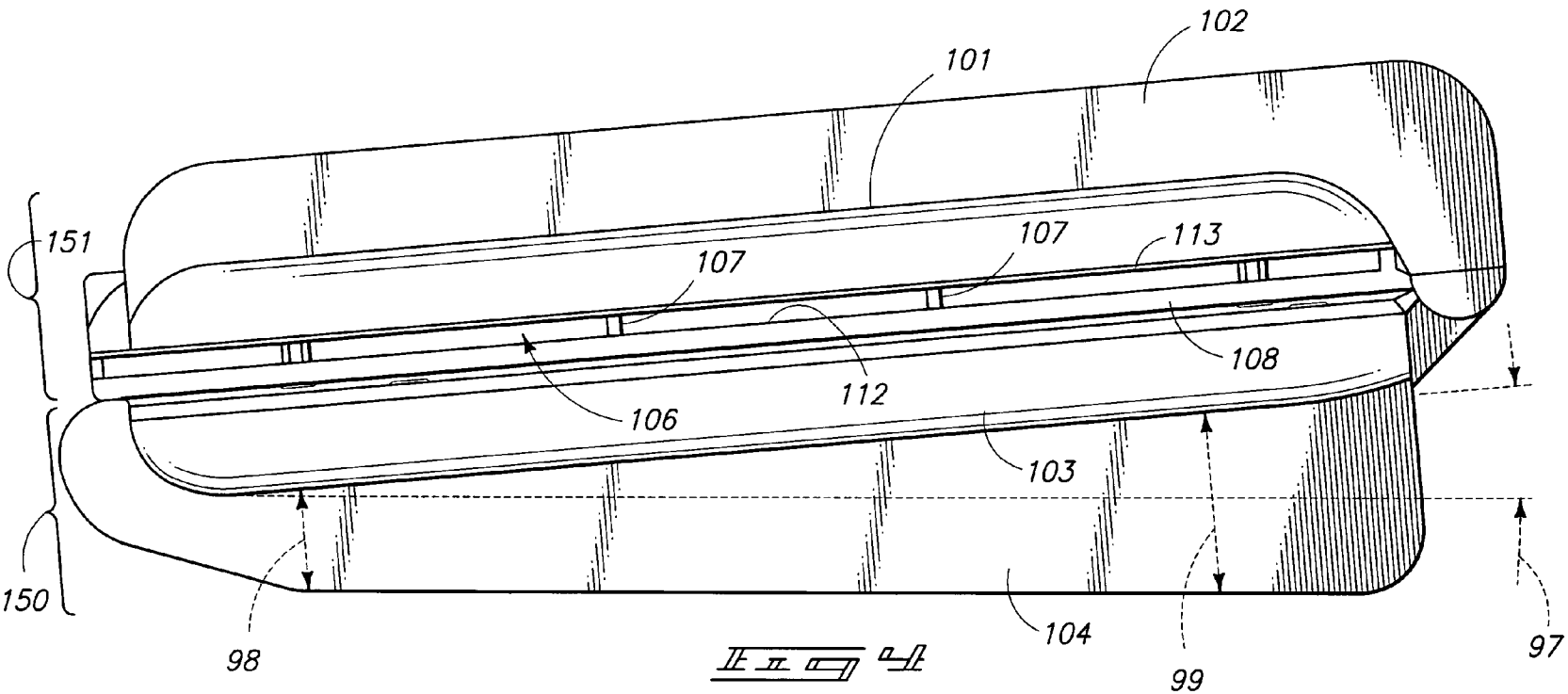
FIG. 11 is a side elevation view of yet another embodiment of this invention positioned within the upper cavity of an exemplary boot, and combined with a more traditional heater.
Figure 11:
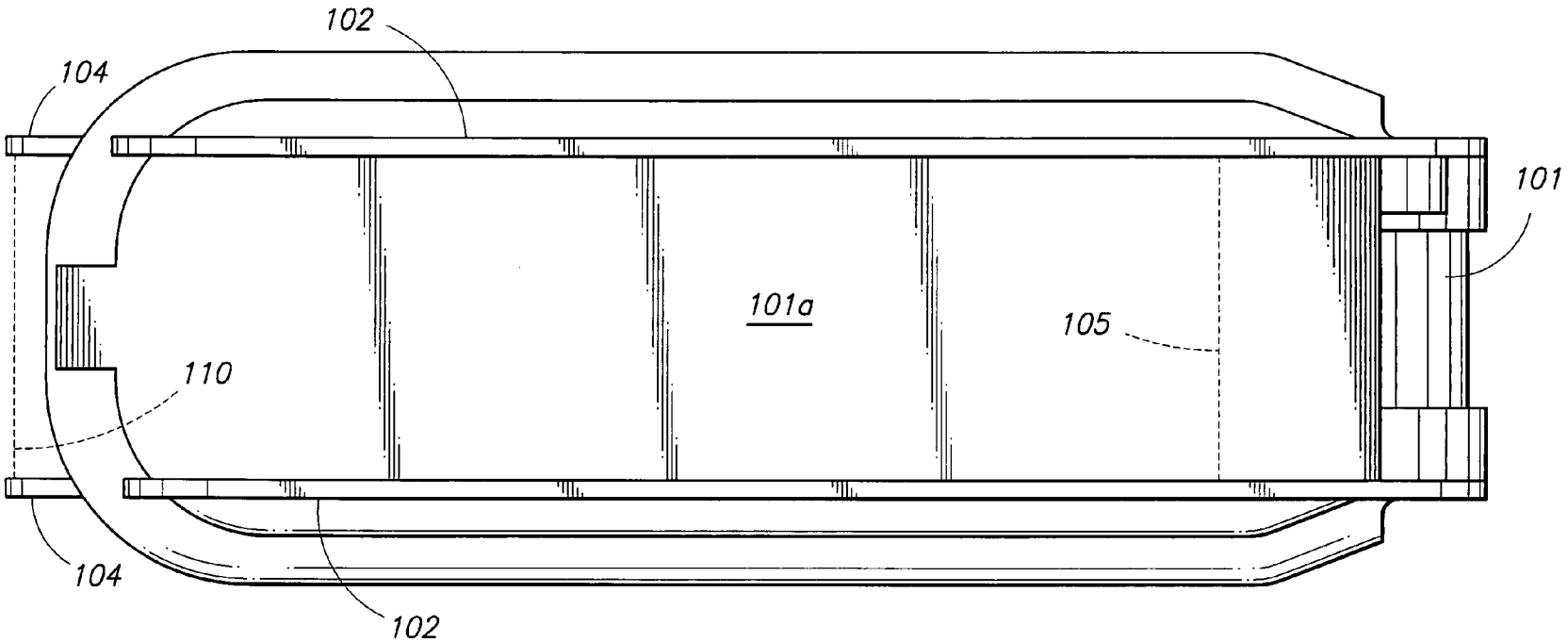

FIG. 11 is a side elevation view of yet another embodiment of this invention positioned within the upper cavity of an exemplary boot, and combined with a more traditional heater 230. FIG. 11 shows upper framework 151, heater 230 and electrical conductor 231 between the upper framework 151 and the lower heater 230. This shows one application or embodiment of the invention with just an upper cavity framework in place with a lower source of heat, but is not a preferred utilization of the invention.

As will be appreciated by those of reasonable skill in the art, there are numerous embodiments to this invention, and variations of elements and components which may be used, all within the scope of this invention.

It will also be appreciated by those of ordinary skill in the art that this invention contemplates general air passageways which may be sealed or nearly sealed from one another, the inlet airflow passageway from the exit airflow passageway for example, or passageways which are open to one another (meaning air can flow from one to another even though one is primarily for inlet air and one for exit, outlet or heated air), all within the contemplation of the invention.

One embodiment of this invention, for example, is a dryer for insertion into a cavity in a garment, boot or shoe, the dryer comprising: a framework configured for insertion into a cavity of one of a garment, boot and shoe; a framework heated surface at a first side of the framework, the heated surface forming at least one side of an exit airflow passageway formed by the framework; and a framework heater operatively attached to the framework.

There are numerous additional or alternative embodiments to that stated in the preceding paragraph, such as for dryers: further wherein the framework is a lower: cavity framework and is configured for insertion into a lower cavity; further wherein the framework is an upper cavity framework and is configured for insertion into an upper cavity (which may further comprise a lower framework configured for insertion into a lower cavity of the object to be dried, the lower framework including a lower framework heater; or further wherein the upper cavity framework is pivotally attached to the lower framework); wherein the framework heater is a coiled resistance heater; wherein the exit airflow passageway is open to an inlet air passageway; wherein the lower framework forming at least one side to a lower framework airflow passageway; wherein the framework includes a second side with a second side surface, and further wherein the heated surface on the first side achieves a higher temperature than the second side surface (wherein the heated surface on the first side achieves a higher temperature by at least six degrees Fahrenheit than a temperature of the second side surface, or at least eight degrees Fahrenheit.

In another embodiment of the invention, a dryer is provided for insertion into a cavity in a garment, boot or shoe to be dried, the dryer comprising: an upper cavity framework configured for insertion into an upper cavity of an object to be dried, the upper cavity framework including a first side, a second side and an upper cavity framework heater; wherein the first side of the upper cavity framework is heated to a temperature greater than the second side of the upper cavity framework; and further wherein the heated surface forms at least one side of an exit airflow passageway in the upper cavity of the object to be dried; an upper cavity framework heater operatively attached to the upper cavity framework; and a lower framework configured for insertion into a lower cavity of the object to be dried.

In further embodiments to the preceding paragraph, a dryer may further be provided: wherein the lower framework includes a lower framework heater; which further comprises a heat shield mounted within the upper cavity framework between the upper cavity framework heater and the second side of the upper cavity framework; which further comprises an air gap within the upper cavity framework between the upper cavity framework heater and the second side of the upper cavity framework; which further comprises an air gap within the upper cavity framework between the heat shield and the second side of the upper cavity framework; and/or which further comprises an air gap within the upper cavity framework between the upper cavity framework heater and the second side of the upper cavity framework.

In another embodiment of the invention, a dryer for insertion into a cavity in a garment, boot or shoe to be dried, the dryer comprising: an upper cavity framework configured for insertion into an upper cavity of an object to be dried; an upper cavity framework exit airflow passageway including a heated surface attached to a first side of the upper cavity framework, the heated surface forming at least one side of the exit airflow passageway; an upper cavity framework heater operatively attached to the upper cavity framework such that the upper cavity framework heater provides heat to the heated surface of the upper cavity framework; and a lower framework configured for insertion into a lower cavity of the object to be dried, the lower framework including an exit airflow passageway which includes a heated surface at a first side of the lower framework, the heated surface forming at least one side of the lower framework exit airflow passageway; and a lower framework heater.

In yet another embodiment of the invention, a dryer is provided for insertion into a cavity in a garment, boot or shoe, the dryer comprising: a framework configured for insertion into a cavity of one of a garment, boot and shoe, including a first surface and an opposing second surface; and a heater attached to the framework and configured to provide heat to the first surface to achieve a first surface temperature which is higher than a temperature of the second surface.

In further embodiments to that disclosed in the preceding paragraph, a dryer may be provided: further wherein the first surface defines part of an exit airflow passageway for heated airflow exiting the cavity of the garment, boot or shoe; and/or further comprising at least one passageway wall attached to the framework to provide an exit airflow passageway.

In another embodiment of the invention, a method for drying a cavity in a garment, boot or shoe is disclosed, comprising: providing a dryer framework configured for insertion into a cavity of one of a garment, boot and shoe; and heating a first surface of the dryer framework to a temperature higher than a second and opposing surface of the dryer framework, thereby creating a temperature differential across the dryer framework. This method may, but need not, further be defined wherein the temperature differential creates a drying airflow through the cavity of the garment, boot or shoe; and/or further comprising providing the first surface and one or more passageway walls on the dryer framework as at least part of an airflow passageway for air to exit the cavity.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A natural convection dryer for insertion into a cavity in a garment, boot or shoe, the dryer comprising:

a framework configured for insertion into a cavity of one of a garment, boot and shoe, which may be in an upright position;

a framework heated surface at a first side of the framework, the heated surface forming at least one side of an exit airflow passageway formed by the framework;

a first exit airflow passageway sidewall disposed relative to the heated surface to in part define an exit airflow passageway;

a framework heater operatively attached to the framework; and wherein no forced air convection is provided.

2. A natural convection dryer as recited in claim 1, and further wherein the framework is a lower cavity framework and is configured for insertion into a lower cavity.

3. A natural convection dryer as recited in claim 1, and further wherein the framework is an upper cavity framework and is configured for insertion into an upper cavity.

4. A natural convection dryer as recited in claim 3, and further comprising a lower framework configured for insertion into a lower cavity of the object to be dried, the lower framework including a lower framework heater.

5. A natural convection dryer as recited in claim 4, and further wherein the upper cavity framework is pivotally attached to the lower framework.

6. A natural convection dryer as recited in claim 1, and further wherein the framework heater is a coiled resistance heater.

7. A natural convection dryer as recited in claim 1, and further wherein the exit airflow passageway is open to an inlet air passageway.

8. A natural convection dryer as recited in claim 1, and further wherein the lower framework forming at least one side to a lower framework airflow passageway.

9. A natural convection dryer as recited in claim 1, and wherein the framework includes a second side with a second side surface, and further wherein the heated surface on the first side achieves a higher temperature than the second side surface.

10. A natural convection dryer as recited in claim 9, and further wherein the heated surface on the first side achieves a higher temperature by at least six degrees Fahrenheit than a temperature of the second side surface.

11. A natural convection dryer as recited in claim 9, and further wherein the heated surface on the first side achieves a higher temperature by at least eight degrees Fahrenheit than a temperature of the second side surface.

12. A natural convection dryer for insertion into a cavity in a garment, boot or shoe to be dried, the dryer comprising:

an upper cavity framework configured for insertion into an upper cavity of an object to be dried, the upper cavity framework including a first side, a second side and an upper cavity framework heater;

wherein the first side of the upper cavity framework is heated to a temperature greater than the second side of the upper cavity framework; and further wherein the heated surface forms at least one side of an exit airflow passageway in the upper cavity of the object to be dried, and a first exit airflow passageway sidewall forms a second side of the exit airflow passageway;

an upper cavity framework heater operatively attached to the upper cavity framework;

a lower framework configured for insertion into a lower cavity of the object to be dried; and further wherein no forced air convection is provided.

13. A natural convection dryer as recited in claim 12, and further wherein the lower framework includes a lower framework heater.

14. A natural convection dryer as recited in claim 12, and which further comprises a heat shield mounted within the upper cavity framework between the upper cavity framework heater and the second side of the upper cavity framework.

15. A natural convection dryer as recited in claim 14, and which further comprises an air gap within the upper cavity framework between the upper cavity framework heater and the second side of the upper cavity framework.

16. A natural convection dryer as recited in claim 14, and which further comprises an air gap within the upper cavity framework between the heat shield and the second side of the upper cavity framework.

17. A natural convection dryer as recited in claim 9, and which further comprises an air gap within the upper cavity framework between the upper cavity framework heater and the second side of the upper cavity framework.

18. A natural convection dryer for insertion into a cavity in a garment, boot or shoe to be dried, the dryer comprising:

an upper cavity framework configured for insertion into an upper cavity of an object to be dried;

an upper cavity framework exit airflow passageway including a heated surface attached to a first side of the upper cavity framework, the heated surface forming at least one side of the exit airflow passageway, and disposed to induce upward airflow out of the cavity;

an upper cavity framework heater operatively attached to the upper cavity framework such that the upper cavity framework heater provides heat to the heated surface of the upper cavity framework;

a lower framework configured for insertion into a lower cavity of the object to be dried, the lower framework including an exit airflow passageway which includes a heated surface at a first side of the lower framework, the heated surface forming at least one side of the lower framework exit airflow passageway; and a lower framework heater.

19. A natural convection dryer for insertion into a cavity in a garment, boot or shoe, the dryer comprising:

a framework configured for insertion into a cavity of one of a garment, boot and shoe, including a first surface and an opposing second surface; and a heater attached to the framework and configured to provide heat to the first surface to achieve a first surface temperature which is higher than a temperature of the second surface;

the first surface forming at least one side of an exit airflow passageway; and a first exit airflow passageway sidewall disposed relative to the first surface to in part define an exit airflow passageway.

20. A natural convection dryer as recited in claim 19, and further wherein the first surface defines part of an exit airflow passageway for heated airflow exiting the cavity of the garment, boot or shoe.

21. A natural convection dryer as recited in claim 19, and further comprising at least one passageway wall attached to the framework to provide an exit airflow passageway.

22. A method for drying a cavity in a garment, boot or shoe by natural convection, comprising:

providing a dryer framework configured for insertion into a cavity of one of a garment, boot and shoe;

providing a first surface of the dryer framework forming at least one side of an exit airflow passageway:

providing a first exit airflow passageway sidewall disposed relative to the first surface to in part define an exit airflow passageway which directs airflow upward out of the garment, boot or shoe;

heating the first surface of the dryer framework to a temperature higher than a second and opposing surface of the dryer framework, thereby creating a temperature differential across the dryer framework.

23. A method as recited in claim 22, and further wherein the temperature differential creates a drying airflow through the cavity of the garment, boot or shoe.

24. A natural convection dryer as recited in claim 1, and further comprising a second exit passageway sidewall disposed relative to the heated surface to in part define an exit airflow passageway, and wherein the heated surface, the first exit passageway sidewall and the second exit passageway sidewall define three sides of the exit passageway.

25. A natural convection dryer as recited in claim 1, and further comprising a second exit passageway sidewall disposed relative to the heated surface to in part define an exit airflow passageway, and wherein the first exit passageway is contiguous with the heated surface and the second exit passageway is contiguous with the heated surface.

26. A natural convection dryer as recited in claim 12, and further comprising a second exit passageway sidewall disposed relative to the heated surface to in part define an exit airflow passageway, and wherein the heated surface, the first exit passageway sidewall and the second exit passageway sidewall define three sides of the exit passageway.

27. A method as recited in claim 22 and further providing wherein a second exit passageway sidewall disposed relative to the heated surface to in part define an exit airflow passageway, and wherein the heated surface, the first exit passageway sidewall and the second exit passageway sidewall define three sides of the exit passageway.

* * * * *